US007086478B2

(12) United States Patent
Simpson et al.

(10) Patent No.: US 7,086,478 B2
(45) Date of Patent: Aug. 8, 2006

(54) APPARATUS AND METHODS FOR EXPANDING TUBULARS IN A WELLBORE

(75) Inventors: Neil A. A. Simpson, Aberdeen (GB); David Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/082,738

(22) Filed: Mar. 17, 2005

(65) Prior Publication Data

US 2005/0155771 A1 Jul. 21, 2005

Related U.S. Application Data

(60) Continuation of application No. 10/796,250, filed on Mar. 9, 2004, now Pat. No. 6,902,000, which is a continuation of application No. 10/212,304, filed on Aug. 5, 2002, now Pat. No. 6,712,142, which is a division of application No. 09/828,508, filed on Apr. 6, 2001, now Pat. No. 6,578,630, and a continuation-in-part of application No. 09/469,690, filed on Dec. 22, 1999, now Pat. No. 6,457,532, and a continuation-in-part of application No. 09/469,692, filed on Dec. 22, 1999, now Pat. No. 6,325,148.

(60) Provisional application No. 60/202,335, filed on May 5, 2000.

(51) Int. Cl.
*E21B 19/16* (2006.01)
*E21B 23/02* (2006.01)

(52) U.S. Cl. ..... 166/380; 166/384; 166/207

(58) Field of Classification Search ..... 166/380, 166/384, 207

See application file for complete search history.

(56) References Cited

U.S. PATENT DOCUMENTS

| | | | |
|---|---|---|---|
| 761,518 | A | 5/1904 | Lykken |
| 1,324,303 | A | 12/1919 | Carmichael |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,930,825 | A | 10/1933 | Raymond |
| 2,383,214 | A | 8/1945 | Prout |
| 2,499,630 | A | 3/1950 | Clark |
| 2,627,891 | A | 2/1953 | Clark |
| 2,663,073 | A | 12/1953 | Bieber et al. |
| 2,898,971 | A | 8/1959 | Hempel |
| 3,087,546 | A | 4/1963 | Woolley |
| 3,195,646 | A | 7/1965 | Brown |
| 3,467,180 | A | 9/1969 | Pensotti |
| 3,785,193 | A | 1/1974 | Kinley et al. |

(Continued)

FOREIGN PATENT DOCUMENTS

EP 0 961 007 A2 12/1999

(Continued)

OTHER PUBLICATIONS

PCT International Search Report for PCT/GB 01/01966.

(Continued)

*Primary Examiner*—William Neuder
(74) *Attorney, Agent, or Firm*—Patterson & Sheridan, L.L.P.

(57) ABSTRACT

The present invention relates to methods and apparatus for expanding tubulars in a wellbore. In one aspect of the invention, an expansion tool with hydraulically actuated, radially expandable members is disposed on a string of coil tubing. In another aspect of the invention the apparatus is utilized to expand a tubular lining a lateral wellbore into contact with a window of a larger tubular lining a central wellbore.

18 Claims, 6 Drawing Sheets

U.S. PATENT DOCUMENTS

| | | | |
|---|---|---|---|
| 3,818,734 | A | 6/1974 | Bateman |
| 3,911,707 | A | 10/1975 | Minakov et al. |
| 4,069,573 | A | 1/1978 | Rogers et al. |
| 4,127,168 | A | 11/1978 | Hanson et al. |
| 4,159,564 | A | 7/1979 | Cooper, Jr. |
| 4,288,082 | A | 9/1981 | Setterberg |
| 4,324,407 | A | 4/1982 | Upham et al. |
| 4,429,620 | A | 2/1984 | Burkhardt et al. |
| 4,531,581 | A | 7/1985 | Pringle et al. |
| 4,588,030 | A | 5/1986 | Blizzard |
| 4,697,640 | A | 10/1987 | Szarka |
| 4,848,469 | A | 7/1989 | Baugh et al. |
| 5,271,472 | A | 12/1993 | Leturno |
| 5,409,059 | A | 4/1995 | McHardy |
| 5,435,400 | A | 7/1995 | Smith |
| 5,472,057 | A | 12/1995 | Winfree |
| 5,560,426 | A | 10/1996 | Trahan et al. |
| 5,685,369 | A | 11/1997 | Ellis et al. |
| 5,887,655 | A | 3/1999 | Haugen et al. |
| 5,901,787 | A | 5/1999 | Boyle |
| 5,957,225 | A | 9/1999 | Sinor |
| 6,021,850 | A | 2/2000 | Wood et al. |
| 6,070,671 | A | 6/2000 | Cumming et al. |
| 6,098,717 | A | 8/2000 | Bailey et al. |
| 6,318,457 | B1 | 11/2001 | Den Boer et al. |
| 6,325,148 | B1 | 12/2001 | Trahan et al. |
| 6,401,815 | B1 | 6/2002 | Surjaatmadja et al. |
| 6,425,444 | B1 | 7/2002 | Metcalfe et al. |
| 6,446,323 | B1 | 9/2002 | Metcalfe et al. |
| 6,457,532 | B1 | 10/2002 | Simpson |
| 6,527,049 | B1 | 3/2003 | Metcalfe et al. |
| 6,543,552 | B1 | 4/2003 | Metcalfe et al. |
| 6,578,630 | B1 | 6/2003 | Simpson et al. |
| 6,712,142 | B1 | 3/2004 | Simpson et al. |
| 2001/0040054 | A1 | 11/2001 | Haugen et al. |
| 2002/0166668 | A1 | 11/2002 | Metcalfe et al. |

FOREIGN PATENT DOCUMENTS

| | | | |
|---|---|---|---|
| EP | 1 006 260 | A2 | 6/2000 |
| GB | 2 320 734 | A | 7/1998 |
| GB | 2335217 | A | 9/1999 |
| JP | 63-207427 | | 8/1988 |
| RU | 2064357 | C1 | 7/1996 |
| RU | 2079633 | C1 | 5/1997 |
| RU | 2144128 | C1 | 10/2000 |
| WO | 93/24728 | | 12/1993 |
| WO | 98/09053 | | 3/1998 |
| WO | 99/18328 | | 4/1999 |
| WO | 99/23354 | | 5/1999 |
| WO | 99/50528 | | 10/1999 |

OTHER PUBLICATIONS

Detlef Hahn (SPE) et al., *Simultaneous Drill And Case Technology—Case Histories, Status and Options for Further Development*, IADC/SPE 59126, pp. 1-9.

APPARATUS AND METHODS FOR EXPANDING TUBULARS IN A WELLBORE

CROSS-REFERENCE TO RELATED APPLICATIONS

This application is a Continuation of U.S. patent application Ser. No. 10/796,250, filed Mar. 9, 2004 now U.S. Pat, No. 6,902,000, which is a Continuation of U.S. patent application Ser. No. 10/212,304, filed Aug. 5, 2002, now U.S. Pat. No. 6,712,142 which is a Divisional of U.S. patent application Ser. No. 09/828,508 filed on Apr. 6, 2001, now U.S. Pat. No. 6,578,630, which claims priority to Provisional U.S. Patent Application Ser. No. 60/202,335, filed on May 5, 2000, and is a Continuation-in-Part of U.S. patent application Ser. No. 09/469,690, filed on Dec. 22, 1999, now U.S. Pat. No. 6,457,532, and is a Continuation-in-Part of U.S. patent application Ser. No. 09/469,692, filed on Dec. 22, 1999, now U.S. Pat. No. 6,325,148, which are hereby incorporated by reference in their entireties.

BACKGROUND OF THE INVENTION

1. Field of the Invention

The present invention relates to methods and apparatus for use in a wellbore; more particularly the invention relates to methods and apparatus for expanding tubulars in a wellbore.

2. Background of the Related Art

The drilling, completion and servicing of hydrocarbon wells requires the use of strings of tubulars of various sizes in a wellbore in order to transport tools, provide a path for drilling and production fluids and to line the wellbore in order to isolate oil bearing formations and provide support to the wellbore. For example, a borehole drilled in the earth is typically lined with casing which is inserted into the well and then cemented in place. As the well is drilled to a greater depth, smaller diameter strings of casing are lowered into the wellbore and attached to the bottom of the previous string of casing. Tubulars of an ever-decreasing diameter are placed into a wellbore in a sequential order, with each subsequent string necessarily being smaller than the one before it. In each instance, a sufficient amount of space must exist in an annular area formed between the tubulars in order to facilitate the fixing, hanging and/or sealing of one tubular from another or the passage of cement or other fluid through the annulus. Typically, when one tubular is hung in a wellbore, a slip assembly is utilized between the outside of the smaller tubular and the inner surface of the larger tubular therearound. One such assembly includes moveable portions which are driven up cone-shaped members to affix the smaller tubular to the larger tubular in a wedging relationship.

Increasingly, lateral wellbores are created in wells to more fully or effectively access hydrocarbon bearing formations. These lateral wellbores are formed off of a vertical wellbore and are directed outwards through the use of a diverter, like a whipstock. After the lateral wellbores are formed, they are typically lined with a tubular creating a junction between the tubulars lining the vertical and lateral wellbores. The junction must be sealed to maintain an independent flow path in and around the wellbores. While technologies have effectively provided means for forming and lining the lateral wellbore, an effective sealing solution for the junction created at the intersection of the vertical and lateral wellbores remains a problem.

There is a need, therefore, for apparatus and methods to quickly and easily expand a tubular in a wellbore to a given diameter. There is a further need for apparatus and methods which permit a tubular of a certain diameter to be inserted into a wellbore and to subsequently permit the diameter of that tubular to be expanded in the wellbore to maximize the fluid or tool carrying capacity of the tubular or to cause the outer surface of the tubular to interfere with the inner surface of a larger tubular therearound. There is yet a further need, for methods and apparatus for expanding tubulars in a wellbore which permit one tubular to be expanded into a window formed in another tubular to create a sealing relationship. There is yet a further need for methods and apparatus permitting a tubular to be expanded into an opening in a larger tubular therearound to create a sealing relationship.

SUMMARY OF THE INVENTION

The present invention relates to methods and apparatus for expanding tubulars in a wellbore. In one aspect of the invention, an expansion tool with hydraulically actuated, radially expandable members is disposed on a string of coil tubing. The string of coil tubing is inserted into the wellbore from a reel at the surface of the well. In addition to providing transportation for the expansion tool into the wellbore, the coil tubing provides a source of hydraulic fluid from the surface of the well to actuate the expansion tool therebelow. A mud motor disposed on the coil tubing string above the expansion tool provides the expansion tool with rotary power. With the expansion tool lowered into a wellbore to a predetermined location within a tubular therearound, the expansion tool may be actuated and rotated and some portion of the tubular therearound expanded to a larger diameter.

In another aspect of the invention, an apparatus includes an expansion tool, a tractor and a mud motor disposed on a coiled tubing string. The tractor, with radially expandable members actuated by hydraulic fluid from the coiled tubing and rotated by the mud motor, propels the apparatus axially in the wellbore while the expansion tool expands the tubular therearound through radial force and rotation. In use, the apparatus is lowered into the wellbore from the surface of the well to a predetermined depth within a tubular therearound. Thereafter, the tractor is actuated by the mud motor and provides axial movement of the apparatus while the expansion tool rotates and expansion members thereupon are actuated to increase the diameter of a tubular therearound.

In another aspect of the invention, an apparatus is provided having an electric motor, at least one pump and a hydraulic fluid reservoir disposed in a housing with an expansion tool disposed therebelow. The apparatus is run into the well on a wireline which provides support for the weight of the apparatus and electrical power for the components therein. More specifically, the apparatus is lowered into a tubular in a wellbore to a predetermined depth. Thereafter, electric power supplied to the motor operates the pump to provide pressurized fluid to actuate the expansion tool and a shaft extending from the pump provides rotational power to the expansion tool.

In another aspect of the invention, the apparatus further includes a tractor run into the well on wireline along with the expansion tool and the housing enclosing the pump reservoir and motor. The electrical motor operates the pump which provides a source of pressurized fluid to the tractor and the expansion tool. Rotational force to the expansion tool and tractor is provided by an output shaft from the electric motor. In use, the tractor imports axial movement to the apparatus in the wellbore while the expansion tool rotates and expandable members thereupon increase the diameter of the tubular therearound.

In yet another aspect of the invention, an apparatus includes a housing with two pumps and an electric motor disposed therein. Disposed above the housing is a tractor and disposed below the housing is an expansion tool. The apparatus is run into the wellbore on wireline which provides support for the weight of the apparatus and electrical power for the electric motor. In use, the electric motor provides power to an upper pump which actuates radially expandable members of the tractor thereby imparting axial movement to the apparatus in the wellbore. Additionally, the electric motor provides power to a lower pump which actuates the expansion tool therebelow. Both the expansion tool and tractor rotate to move the assembly axially in the wellbore and expand a longitudinal section of the tubular when desired.

In a further aspect of the invention a method is provided using the apparatus of the present invention to expand one tubular into a window formed in another tubular to effect a substantially sealed junction between a vertical and lateral wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
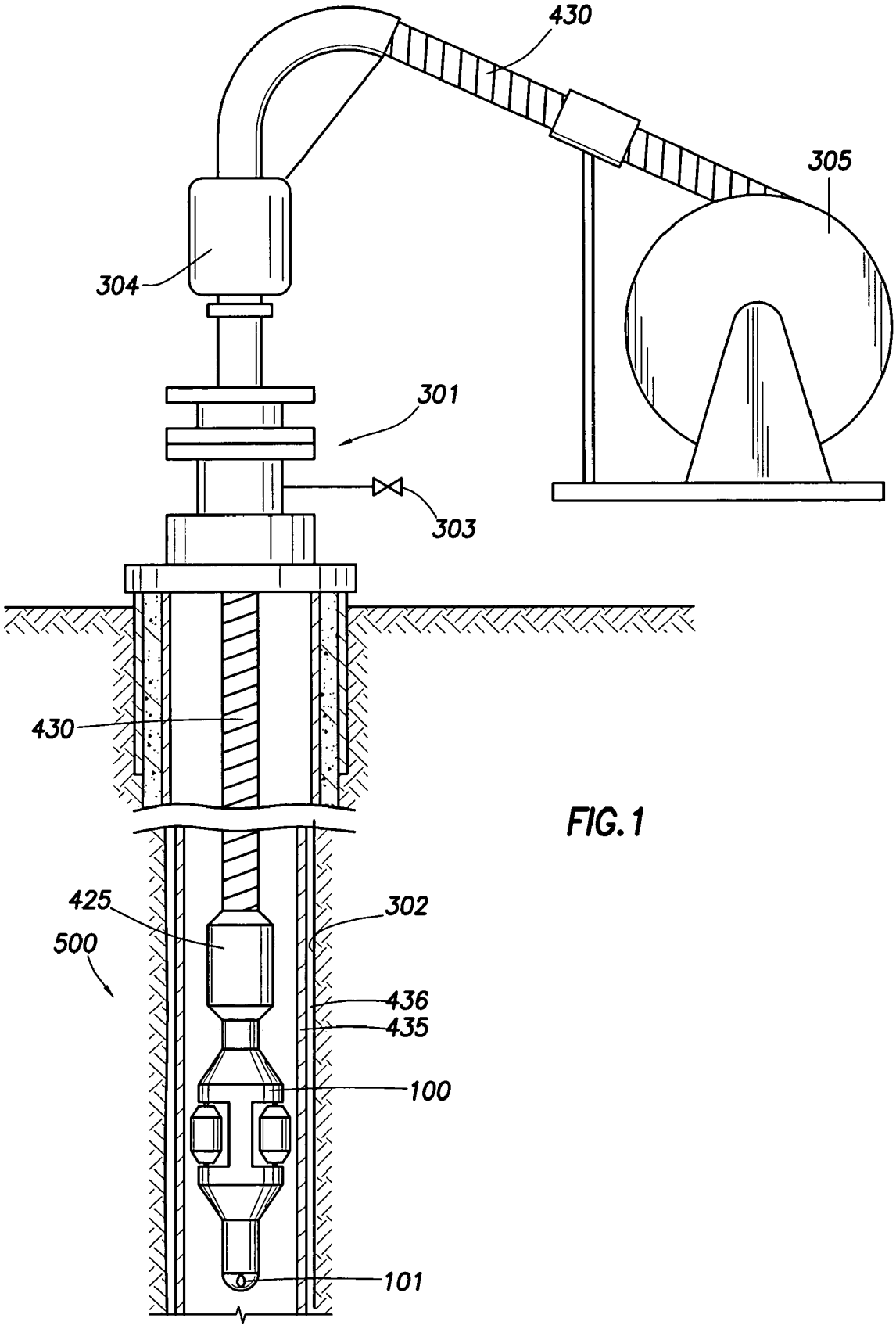
FIG. 1 is a partial section view of an apparatus for expanding a tubular in a wellbore comprising an expansion tool and a mud motor thereabove, both of which are disposed on a string of coil tubing.
Figure 2:
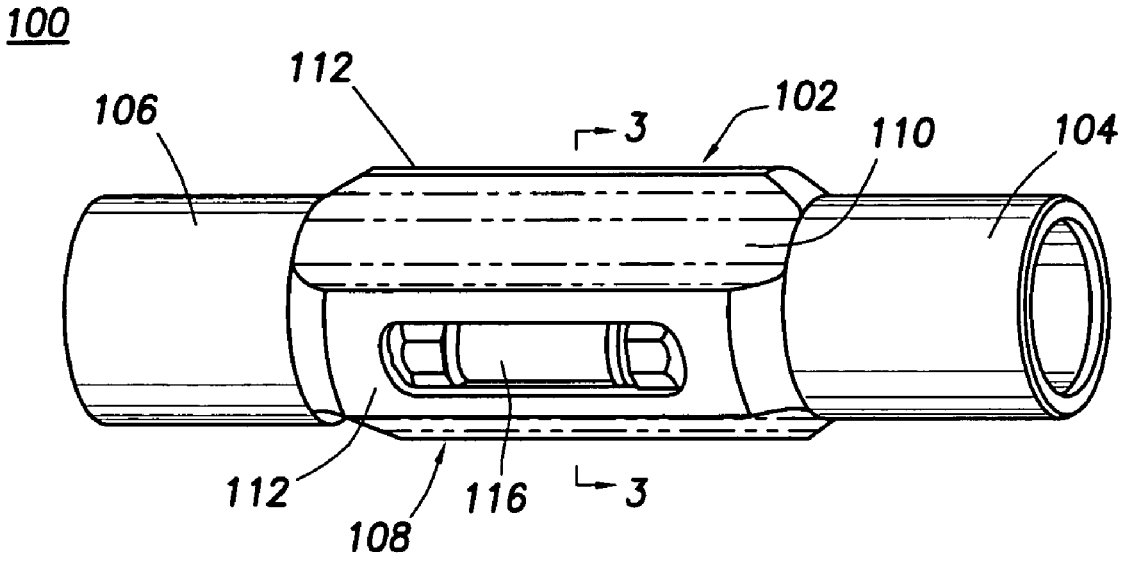
FIG. 2 is a perspective view of an expansion tool of the present invention.
Figure 3:
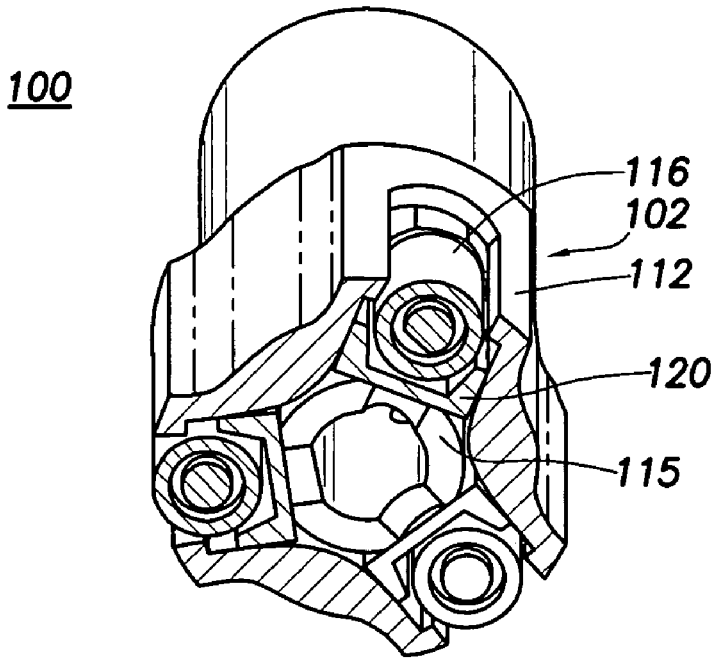
FIG. 3 is a perspective end view in section thereof.
Figure 4:
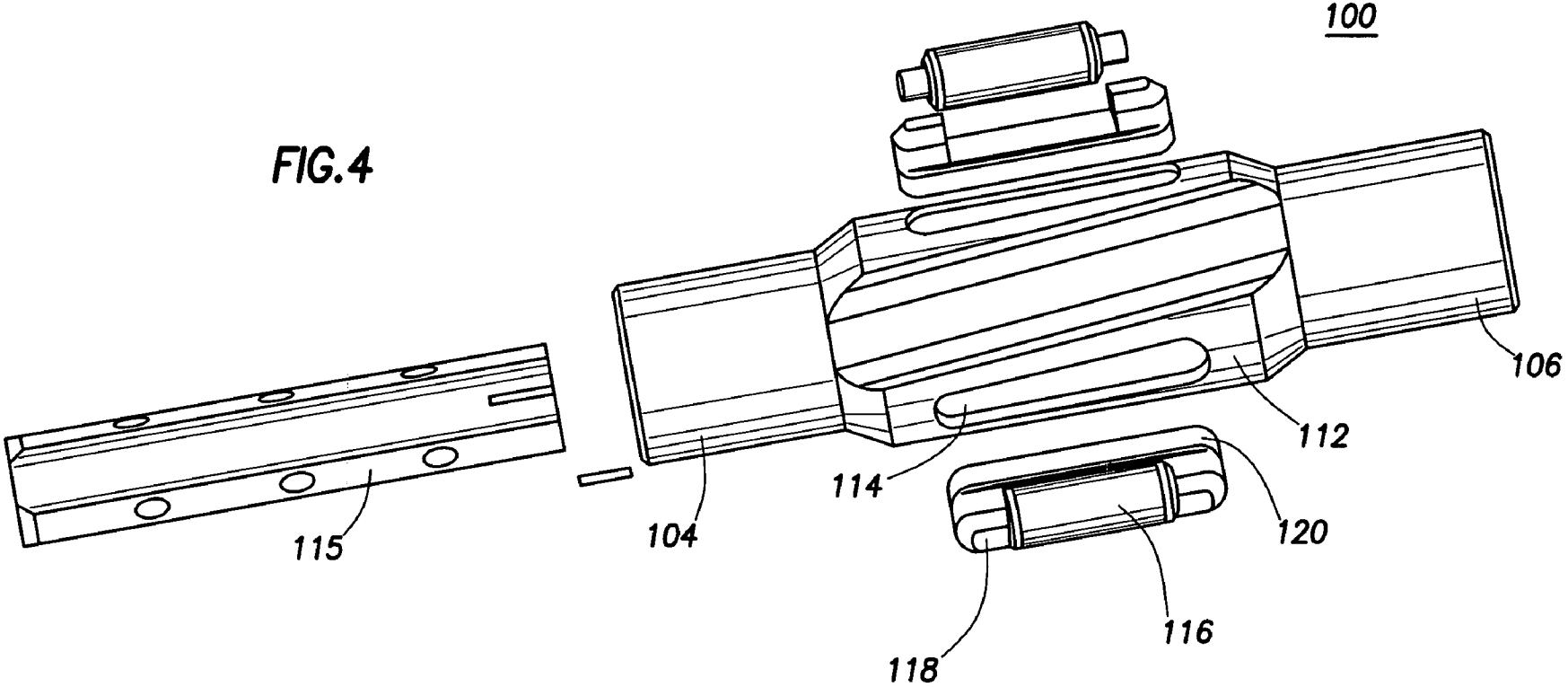
FIG. 4 is an exploded view of the expansion tool.

The present invention provides apparatus and methods for expanding tubulars in a wellbore. FIG. 1 is a section view illustrating an apparatus 500 according to one embodiment of the present invention in a wellbore 302. The apparatus 500 is shown in the interior of a tubular 435 and an annular area 436 is formed between the tubular 435 and the wellbore 302 therearound. At the surface of the well is a wellhead 301 with a valve 303 and a spool 305 of coil tubing 430. In the case of a pressurized wellbore, a stripper 304 or some other pressure retaining device is used in conjunction with the coil tubing string. The apparatus 500 includes an expansion tool 100 disposed at the lower end thereof. FIGS. 2 and 3 are perspective views of the expansion tool 100 and FIG. 4 is an exploded view thereof. The expansion tool 100 has a body 102 which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 100 to the exterior of the respective land 112. Each of the mutually identical rollers 116 is near-cylindrical and slightly barreled. Each of the rollers 116 is mounted by means of a bearing 118 at each end of the respective roller for rotation about a respective rotational axis which is parallel to the longitudinal axis of the tool 100 and radially offset therefrom at 120-degree mutual circumferential separations around the central body 108. The bearings 118 are formed as integral end members of radially slidable pistons 120, one piston 120 being slidably sealed within each radially extended recess 114. The inner end of each piston 120 (FIG. 3) is exposed to the pressure of fluid within the hollow core of the tool 100 by way of the radial perforations in the tubular core 115.

Referring again to FIG. 1, in the apparatus 500 of the present embodiment, fluid pressure to actuate the rollers 116 of the expansion tool 100 is provided from the surface of the well through a coiled tubing string 430. The expander tool 100 of apparatus 500 includes at least one aperture 101 at a lower end thereof. Aperture 101 permits fluid to pass through the apparatus 500 and to circulate back to the surface of the well. Disposed above the expansion tool 100 and providing rotational forces thereto is a mud motor 425. The structure of the mud motors is well known. The mud motor can be a positive displacement Moineau-type device and includes a lobed rotor that turns within a lobed stator in response to the flow of fluids under pressure in the coiled tubing string 430. The mud motor 425 provides rotational force to rotate the expansion tool 100 in the wellbore 302 while the rollers 116 are actuated against an inside surface of a tubular 435 therearound. The tubular 435 disposed around the apparatus of the present invention could be a piece of production tubing, or liner or slotted liner which requires either the expansion of a certain length thereof or at least a profile formed in its surface to affix the tubular within an outer tubular or to facilitate use with some other downhole tool. In FIG. 1, the annulus 436 between the tubular 435 and the wellbore 302 could be a void or could be filled with non-cured cement.

In use, the apparatus 500 is lowered into the wellbore 302 to a predetermined position and thereafter pressurized fluid is provided in the coiled tubing string 430. The pressurized fluid passes through the mud motor 425 providing rotational movement to an output shaft (not shown) that is connected to the expansion tool 100 to provide rotation thereto. In the preferred embodiment, some portion of the fluid is passed through an orifice or some other pressure increasing device and into the expansion tool 100 where the fluid urges the rollers 116 outwards to contact the wall of the tubular 435 therearound. The expansion tool 100 exerts forces against the wall of a tubular 435 therearound while rotating and, optionally, moving axially within the wellbore 302. The result is a tubular that is expanded past its elastic limits along at least a portion of its outside diameter. Gravity and the weight of the components urges the apparatus 500 downward in the wellbore 302 even as the rollers 116 of the expander tool 100 are actuated. Depending upon the requirements of the operator, a fluid path may be left between the expanded tubular and the wellbore in order to provide a flow path for fluids, including cement. For example, the tubular may be expanded in a spiral fashion leaving flute-shaped spaces for the passage of cement or other fluids.

Figure 5:
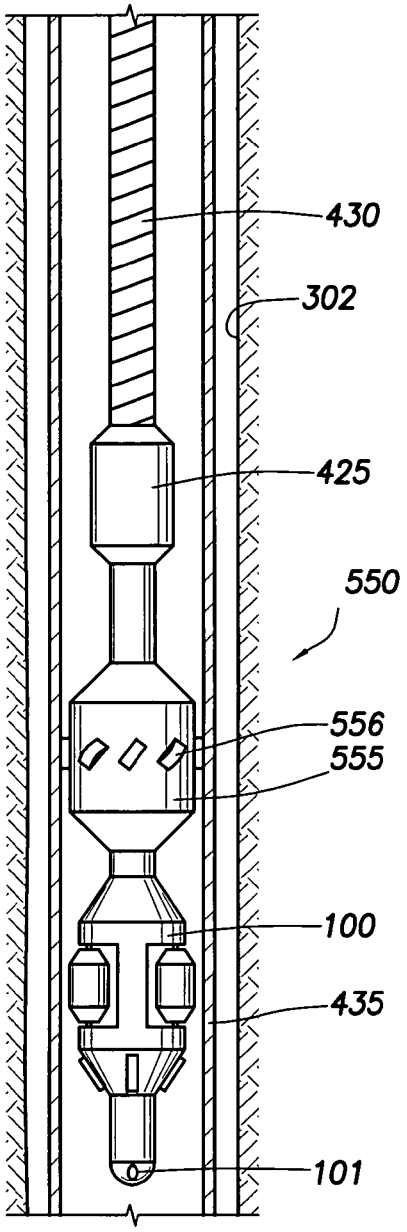
FIG. 5 is a section view of an apparatus including an expansion tool, a tractor disposed thereabove, a mud motor disposed above the tractor and a run-in string of coil tubing.

FIG. 5 is a section view of another embodiment of the invention. In the apparatus 550 of FIG. 5, a tractor 555 is disposed between the mud motor 425 and the expansion tool 100. The purpose of the tractor 555 is to provide axial movement to the apparatus 550 in wellbore 302 as the expansion tool 100 is actuated and increases the diameter of the tubular 435 therearound. The use of the tractor 555 is most advantageous when the apparatus 550 is used in a lateral wellbore or in some other circumstance when gravity and the weight of the components is not adequate to cause the actuated expansion tool 100 to move downward along the wellbore. The tractor 555 is also useful in case a specific and predetermined rate of movement of the apparatus is required for a particular activity. Additionally, the tractor 555 may be necessary if the apparatus 550 is to be used to expand the tubular 435 in a "bottom-up" fashion wherein the tractor provides upward movement of the apparatus 550 in the wellbore 302. The direction of axial movement of the tractor in the wellbore is selectable depending upon the orientation of the tractor when it is installed in apparatus 500. In the preferred embodiment, the rotational power to the tractor 555 is provided by the mud motor 425 disposed thereabove. Expandable elements 556 on the tractor allow it to achieve some degree of traction upon the inner walls of the tubular therearound. The expandable elements 556 are actuated by fluid pressure supplied through the coiled tubing string 430. Preferably, the expandable elements 556 have a radial travel adequate to contact the wall of a tubular even after the tubular has been expanded in diameter by the expansion tool 100. In use, the expansion tool 100 rotates while the rollers 116 disposed therearound are actuated and the tractor 555 simultaneously rotates with its actuated expandable elements to provide axial movement to the apparatus 550, typically in a downward direction. In use, the apparatus 550 is lowered into the wellbore 302 to a predetermined depth and thereafter, rollers 116 of the expansion tool 100 and expandable elements 556 of the tractor 555 are actuated with fluid pressure provided in the coiled tubing string 430. Simultaneously, the fluid in the coiled tubing string 430 operates the mud motor 425 and rotation is provided to the expansion tool 100 as well as to tractor 555 to propel the actuated expansion tool 100 downward in the wellbore 401.

Figure 6:
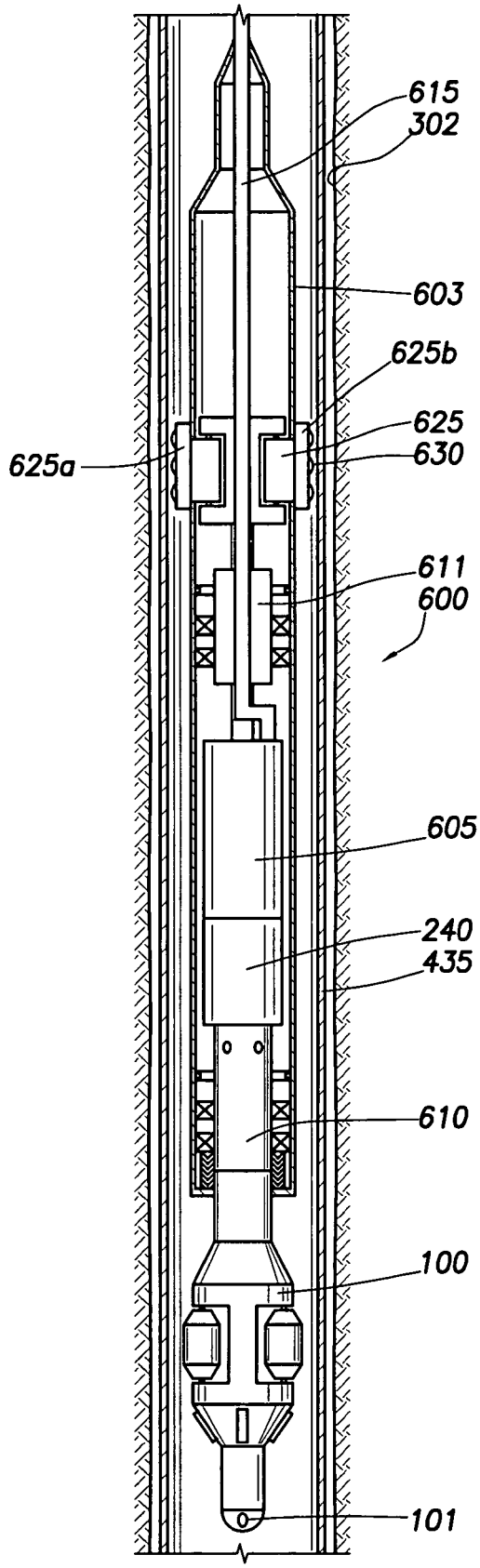
FIG. 6 is a section view of an embodiment of the invention including a housing having an electrical motor, two pumps and an anchor assembly disposed therein, an expansion tool disposed below the housing and wireline used to insert the apparatus into a wellbore and to provide electrical power to the apparatus.

At a lower end of the expansion tool 100 shown in FIGS. 5 and 6 are a plurality of non-compliant rollers constructed and arranged to initially contact and expand a tubular prior to contact between the tubular and fluid actuated rollers 116. Unlike the compliant, fluid actuated rollers 116, the non-compliant rollers 103 are supported only with bearings and they do not change their radial position with respect to the body portion of the tool 100.

FIG. 6 is an alternative embodiment of the invention illustrating an apparatus 600 with a housing 603 having an electric motor 605 and two pumps 610, 611 disposed therein and an expansion tool 100 disposed below. The apparatus 600 is run into the well on armored wireline 615 which provides support for the weight of the apparatus electrical power for the electric motor 605. The electric motor 605 is typically a brushless AC motor in a separate, sealed housing. An output shaft (not shown) extending from the electric motor 605 is coupled to and rotates an input shaft of pump 610 which, in turn, provides a source of rotational force to the expansion tool 100 therebelow. Separately, the electric motor operates the pump 610 which provides pressurized fluid to actuate the rollers 116 of the expansion tool 100. A closed reservoir (not shown) ensures a source of fluid is available to pumps 610, 611.

In order to direct rotation to the expansion tool 100 and prevent the housing 603 from rotating, the apparatus 600 is equipped with an anchor assembly 625 to prevent rotational movement of the housing 603 while allowing the apparatus 600 to move axially within the wellbore 302. The anchor assembly 625 is fluid powered by pump 611 which is also operated by the electric motor 605. The anchor assembly includes at least two anchoring members 625*a*, 625*b*, each equipped with rollers 630. The rollers 630, when urged against the wall of the tubular 435, permit the apparatus 600 to move axially. However, because of their vertical orientation, the rollers 630 provide adequate resistance to rotational force, thereby preventing the housing 603 from rotating as the pump 610 operates and rotates the expansion tool 100 therebelow.

A gearbox 240 is preferably disposed between the output shaft of the electric motor 605 and the rotational shaft of the expansion tool 100. The gearbox 240 functions to provide increased torque to the expansion tool. The pumps 610, 611 are preferably axial piston, swash plate-type pumps having axially mounted pistons disposed alongside the swash plate. The pumps are designed to alternatively actuate the pistons with the rotating swash plate, thereby providing fluid pressure to the components. However, either pump 610, 611 could also be a plain reciprocating, gear rotor or spur gear-type pump. The upper pump, disposed above the motor 605, preferably runs at a higher speed than the lower pump ensuring that the slip assembly 625 will be actuated and will hold the apparatus 600 in a fixed position relative to the tubular 435 before the rollers 116 contact the inside wall of the tubular 435. The apparatus 600 will thereby anchor itself against the inside of the tubular 435 to permit rotational movement of the expansion tool 100 therebelow.

Figure 7:
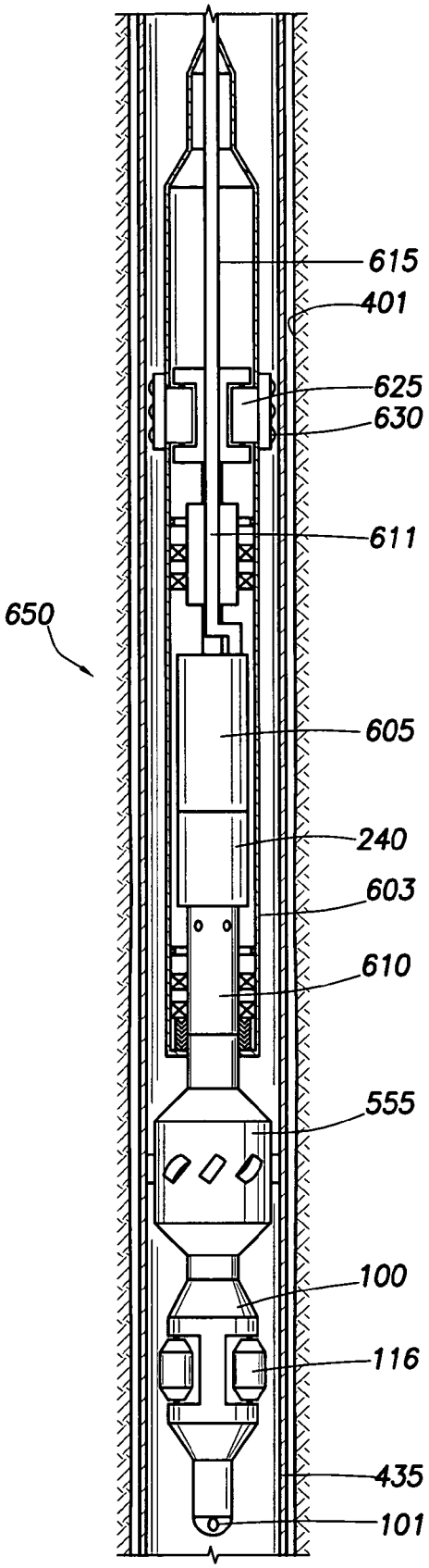
FIG. 7 is a section view of an apparatus of the invention including a housing having an electrical motor, a first and second pump and an anchor assembly disposed therein and a tractor and expansion tool disposed therebelow.

FIG. 7 is another embodiment of the invention. The apparatus 650 of FIG. 7 is similar to the embodiment illustrated in FIG. 6 with the addition of a tractor 555 disposed between the bottom of the housing 603 and the expansion tool 100. The components of the apparatus 650 are similarly numbered as those of apparatus 600 in FIG. 6. The tractor 555, like the tractor of the embodiment illustrated in FIG. 5, is designed to transport the entire apparatus 650 axially within the wellbore 401 as the expansion tool 100 is rotating and the rollers 116 of the expansion tool are actuated and are in contact with tubular 435 therearound. Like the embodiment of FIG. 6, the apparatus 650 is equipped with means to direct rotation to the tractor 555 and to the expansion tool 100 while preventing rotation of the housing 603. An anchor assembly 625 having rollers 630 disposed thereon is located at an upper end of the housing 603 and operates in a fashion similar the one previously described with respect to FIG. 6.

Figure 8:
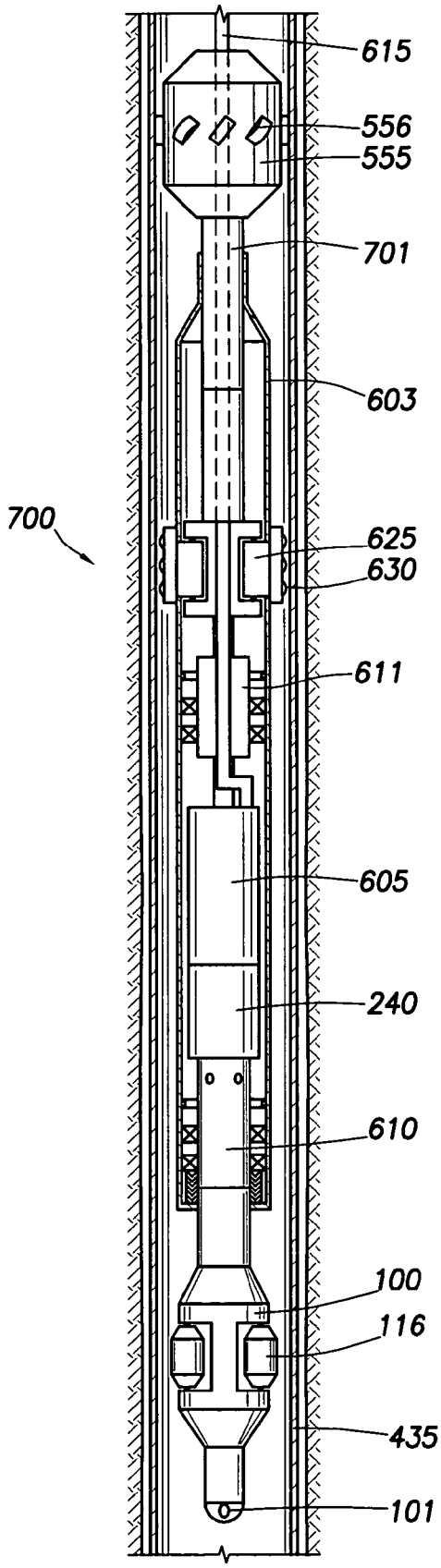
FIG. 8 is a section view of an alternative embodiment of the invention including a housing having an electrical motor, a first and second pump and an anchor assembly disposed therein, an expansion tool disposed below the housing and a tractor disposed above the housing.

FIG. 8 is yet another embodiment of the invention and is similar to the embodiments illustrated in FIGS. 6 and 7 and the like components are numbered similarly. In the apparatus 700 of FIG. 8, the tractor 555 is disposed on an upper end of housing 603. A tubular member 701 is disposed between the tractor and the housing and houses wireline 615 as well as a fluid path (not shown) between pump 611 and tractor 555. In apparatus 700, the electric motor 605 includes a shaft (not shown) extending to the tractor 555 and pump 611 to provide fluid power to the expandable elements 556 of the tractor 555 as well as to the anchor assembly 625. Like the embodiment of FIG. 7, the tractor is constructed and arranged to transport the entire apparatus 700 axially within the wellbore as the expansion tool 100 is rotating and the rollers 116 therearound are actuated to expand tubular 435 therearound.

Figure 9:
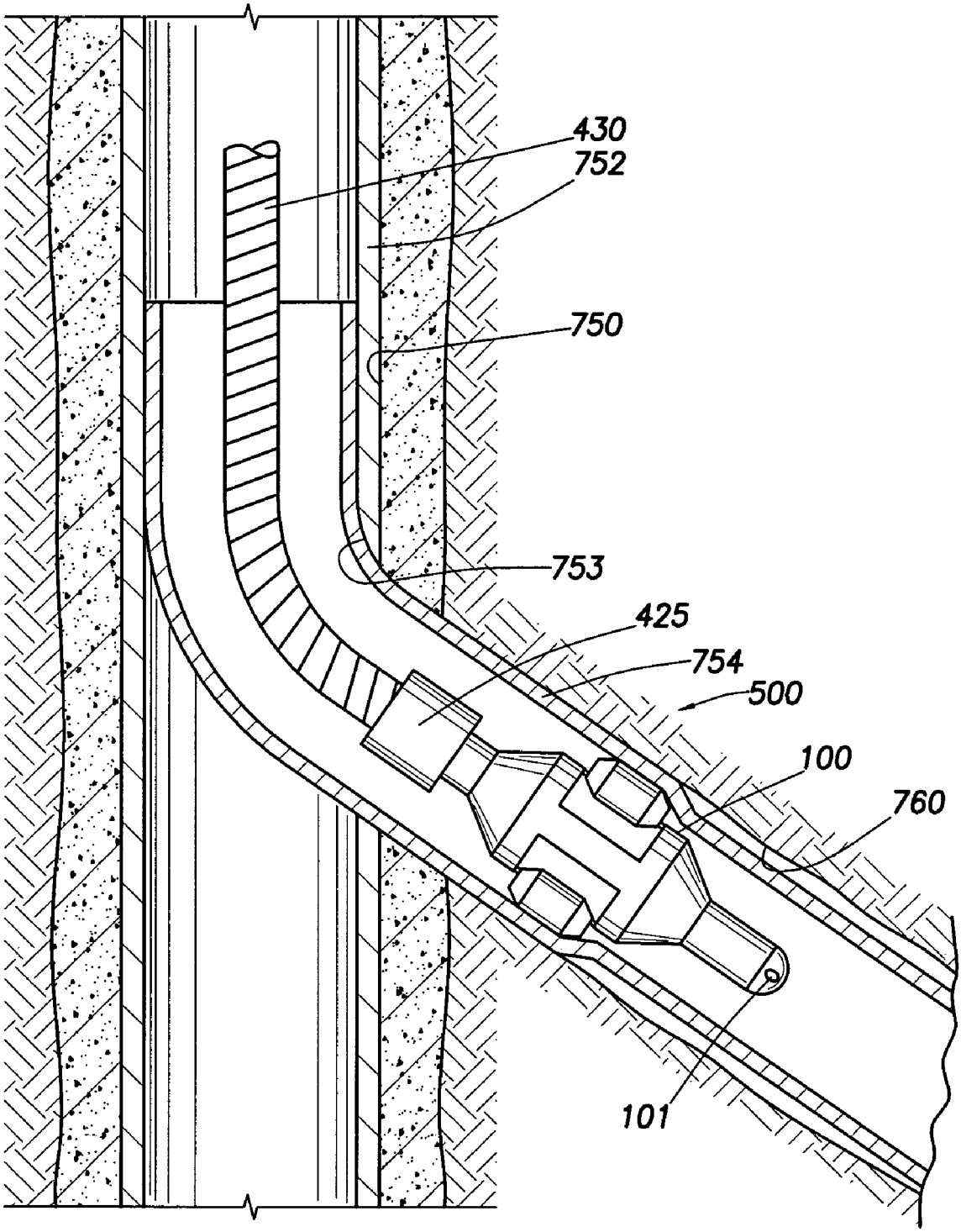
FIG. 9 is a section view of a cased vertical wellbore and a lateral wellbore whereby a tubular lining the lateral wellbore is expanded into a window formed in the casing of the vertical wellbore by an expansion tool with a mud motor thereabove.

FIG. 9 is a section view illustrating one method of using an apparatus 500 of the present invention. Specifically, the section view of FIG. 9 includes a vertical wellbore 750 having casing 752 therein and a lateral wellbore 760 which has been formed from the vertical wellbore. Typically, a vertical wellbore 750 is formed and thereafter, using some diverter like a whipstock (not shown), a window 753 is formed in the casing 752 of the vertical wellbore. Thereafter, a lateral borehole is drilled through the window 753. After the lateral wellbore 760 is formed, a string of tubulars 754 is inserted through the window 753 to line and complete the lateral wellbore 760. Thereafter, using the apparatus 500 of the present invention, the tubular lining the wellbore can be expanded in diameter to seal and/or support the junction between the two wellbores 750, 760. In FIG. 9, a first portion of the tubular 754 lining the lateral wellbore 760 has been selectively expanded into the window 753 between the vertical and lateral wellbores, while a lower portion of the tubular 754 remains at its initial, smaller diameter.

In use, the apparatus 500 of the present invention is be lowered into the wellbore after the lateral wellbore 760 has been formed and a tubular 754 located therein. The expansion tool 100 of the present invention is actuated through the use of the mud motor 425 at some position within the tubular 754, preferably above the window formed in the vertical wellbore casing 752. In order to increase the forward motion of the apparatus, a tractor (not shown) can be used in conjunction with the expansion tool 100. In this manner, the tubular is expanded above the window and as the actuated expansion tool 100 moves through the window 753, the tubular 754 is expanded into the window 753. The junction between the vertical wellbore 750 and the lateral wellbore 760 is in this manner substantially sealed and structurally supported. After tubular 754 is expanded, that portion of the tubular extending upwards from the window 753 towards the well surface can be remotely severed. The method can also be used in a "bottom-up" sequence wherein the tubular lining the horizontal wellbore is expanded from a first point upwards through the window. Alternatively, the apparatus may be used to selectively expand slotted liner in the area of a junction between a main and a lateral wellbore. Also, various material may be used between the interface of the expanded tubular and the window including material designed to effect and enhance a seal and to prevent axial and rotational movement between the outer surface of the expanded tubular and the window.

While the methods and apparatus of the present invention have been described in relative to wellbores of hydrocarbon wells, the aspect of the invention can also be utilized in geothermal wells, water wells, and any other settings where strings of tubulars are utilized in a wellbore.

While foregoing is directed to the preferred embodiment of the present invention, other and further embodiments of the invention may be devised without departing from the basic scope thereof, and the scope thereof is determined by the claims that follow.

The invention claimed is:

1. A method of expanding a liner extending into a lateral wellbore through a window in casing disposed in a wellbore, comprising:

providing an expander having at least two radially extendable expander members disposed about a body such that the at least two radially extendable expander members move in at least two different radial directions, each expander member having a retracted and an extended position and each member having a piston surface for moving the member to the extended position with a pressurized fluid, wherein, in the extended position, the expander members are configured to permit radially inward movement due to inwardly directed forces; and expanding the liner at least across a portion of the liner proximate the window with the expander.

2. The method of claim 1, further comprising removing at least a portion of the liner extending into the wellbore from the window.

3. The method of claim 1, further comprising expanding a portion of the liner disposed in the wellbore.

4. The method of claim 1, further comprising expanding a portion of the liner disposed in the lateral wellbore.

5. The method of claim 1, further comprising expanding a portion of the liner disposed in the wellbore and a portion of the liner disposed in the lateral wellbore.

6. The method of claim 1, further comprising inserting the liner through the window.

7. The method of claim 1, further comprising disposing a material between an interface of the liner and the window to enhance a seal.

8. A method of expanding a liner extending into a lateral wellbore through a window in casing disposed in a wellbore, comprising:

providing an expander having at least one radially extendable member, the radially extendable member configured to chance radial positions between a first unextended position, and a second fully extended position, wherein the radially extendable member moves from the first position upon application of a force to the radially extendable member;

locating a material between an interface of the liner and the window to enhance a seal and prevent movement between an outer surface of the liner and the window;

locating the expander inside the liner;

applying the force to the radially extendable member;

engaging the radially extendable member with an inner diameter of the liner; and expanding the liner across the window with the radially extendable member.

9. The method of claim 8, further comprising removing at least a portion of the liner extending into the wellbore from the window.

10. The method of claim 8, further comprising expanding a portion of the liner disposed in the wellbore.

11. The method of claim 8, further comprising expanding a portion of the liner disposed in the lateral wellbore.

12. The method of claim 8, further comprising expanding a portion of the liner disposed in the wellbore and a portion of the liner disposed in the lateral wellbore.

13. A method of expanding a liner extending into a lateral wellbore through a window in casing disposed in a wellbore, comprising:

locating an expander inside the liner, the expander having at least two circumferentially spaced radially extendable members movable between a first extended position and a second lesser extended position, wherein the at least two radially extendable members are biased toward the first extended position;

operating the expander to the first extended position; and moving the expander axially within the liner to expand a length of the liner across the window.

14. The method of claim 13, further comprising removing at least a portion of the liner extending into the wellbore from the window.

15. The method of claim 13, further comprising expanding a portion of the liner disposed in the wellbore.

16. The method of claim 13, further comprising expanding a portion of the liner disposed in the lateral wellbore.

17. The method of claim 13, further comprising expanding a portion of the liner disposed in the wellbore and a portion of the liner disposed in the lateral wellbore.

18. A method of expanding a liner extending into a lateral wellbore through a window in casing disposed in a wellbore, comprising:

inserting the liner from an interior of the casing through the window in a wall of the casing; and expanding the liner with a compliant expansion tool into a substantial conformal relationship with the window, thereby substantially sealing the liner to the casing at the window, wherein the compliant expansion tool has at least two circumferentially spaced radially extendable members.

* * * * *

UNITED STATES PATENT AND TRADEMARK OFFICE

CERTIFICATE OF CORRECTION

PATENT NO. : 7,086,478 B2
APPLICATION NO. : 11/082738
DATED : August 8, 2006
INVENTOR(S) : Neil A. A. Simpson and David Haugen It is certified that error appears in the above-identified patent and that said Letters Patent is hereby corrected as shown below:

<u>In the Claims section</u>:

In column 8, Claim 8, line 56, please delete “chance” and insert --change--.

In column 8, Claim 8, line 57, please delete the comma “,” after “position” and before “and”.

Signed and Sealed this

Twentieth Day of March, 2007

JON W. DUDAS
*Director of the United States Patent and Trademark Office*